US011248753B1

(12) United States Patent
Li

(10) Patent No.: US 11,248,753 B1
(45) Date of Patent: Feb. 15, 2022

(54) LED LIGHT BULB

(71) Applicant: Xiamen Longstar Lighting Co., Ltd., Fujian (CN)

(72) Inventor: Xilong Li, Fujian (CN)

(73) Assignee: Xiamen Longstar Lighting Co., Ltd., Xiamen (CN)

( * ) Notice: Subject to any disclaimer, the term of this patent is extended or adjusted under 35 U.S.C. 154(b) by 0 days.

(21) Appl. No.: 17/351,490

(22) Filed: Jun. 18, 2021

(30) Foreign Application Priority Data

Mar. 1, 2021 (CN) ..... 202120442979.3

(51) Int. Cl.

| | |
|---|---|
| ***F21K 9/232*** | (2016.01) |
| ***F21K 9/237*** | (2016.01) |
| ***F21V 23/04*** | (2006.01) |
| ***F21V 29/70*** | (2015.01) |

(52) U.S. Cl.
CPC ..... *F21K 9/232* (2016.08); *F21K 9/237* (2016.08); *F21V 23/04* (2013.01); *F21V 29/70* (2015.01)

(58) Field of Classification Search
None
See application file for complete search history.

(56) References Cited

U.S. PATENT DOCUMENTS

| | | | | |
|---|---|---|---|---|
| 7,665,882 | B1 * | 2/2010 | Wang | F21K 9/00 362/650 |
| 2012/0187835 | A1 * | 7/2012 | Jonsson | F21V 3/02 315/51 |
| 2015/0061497 | A1 * | 3/2015 | Martins | H05B 45/10 315/112 |
| 2018/0092183 | A1 * | 3/2018 | Halliwell | H05B 45/20 |
| 2018/0094778 | A1 * | 4/2018 | Sokol | F21K 9/232 |
| 2019/0242533 | A1 * | 8/2019 | Smith | F21K 9/238 |
| 2020/0187319 | A1 * | 6/2020 | Jiang | H05B 47/19 |
| 2021/0120644 | A1 * | 4/2021 | Halliwell | H05B 45/10 |

* cited by examiner

*Primary Examiner* — Britt D Hanley
(74) *Attorney, Agent, or Firm* — Cooper Legal Group, LLC

(57) ABSTRACT

The present disclosure discloses an LED light bulb comprising a light source board, a heat sink, a lamp shade, and a paddle member is provided. The light source board is disposed on an upper end surface of the heat sink, and the lamp shade is connected to the upper end surface of the heat sink to enable the light source board to be contained within the lamp shade. A patch switch comprises a paddle handle extending downwardly along an axial direction of the heat sink. A front end of the paddle member is configured to extend through a space-providing opening and to be operatively coupled to the paddle handle, a rear end of the paddle member defines an operating member, and the operating member is configured to be paddled to adjust turning ON and OFF of LED beads of different colors disposed on the light source board.

10 Claims, 4 Drawing Sheets

LED LIGHT BULB

RELATED APPLICATIONS

This application claims priority to Chinese patent application number 202120442979.3, filed on Mar. 1, 2021. Chinese patent application number 202120442979.3 is incorporated herein by reference.

FIELD OF THE DISCLOSURE

The present disclosure relates to a lighting device, in particular to a light emitting diode (LED) light bulb.

BACKGROUND OF THE DISCLOSURE

With the improvement of people's living standards, light bulbs not only provide a single lighting function, but also have functions such as atmosphere adjustment. This requires the light bulbs to have a function of changing light color, so as to enable the light color to be changed for different occasions and create specific atmospheres. The traditional color adjustable LED light bulb is assembled by welding a switch to a driver board, and then welding the driver board with the switch to a light source board, which is troublesome and expensive to assemble.

BRIEF SUMMARY OF THE DISCLOSURE

The present disclosure provides an LED light bulb which has a simple structure and is easy to assemble.

In order to solve the technical problem, a technical solution of the present disclosure is as follows.

A light emitting diode (LED) light bulb comprises a light source board, a heat sink, a lamp shade, and a paddle member. The light source board is disposed on an upper end surface of the heat sink in an axial direction of the heat sink. The lamp shade is connected to the upper end surface of the heat sink to enable the light source board to be contained within the lamp shade. The light source board comprises a patch switch, and the patch switch comprises a paddle handle extending downwardly along the axial direction of the heat sink. The heat sink comprises a space-providing opening. A front end of the paddle member is configured to extend through the space-providing opening and to be operatively coupled to the paddle handle, a rear end of the paddle member is configured to be exposed out of an outer wall of the heat sink to define an operating member, and the operating member is configured to be toggled to adjust turning ON and OFF of LED beads of different colors disposed on the light source board.

In a preferred embodiment, the light source board comprises a driver circuit.

In a preferred embodiment, a lower end of the heat sink in the axial direction of the heat sink is connected to a light bulb base, and a positive input terminal and a negative terminal of the driver circuit are respectively electrically connected to a positive contact and a negative contact of the light bulb base.

In a preferred embodiment, the LED beads disposed on the light source board are arranged in a circumferential array to define a circle, and the patch switch is disposed in the circle defined by the LED beads.

In a preferred embodiment, an installation post is defined within the heat sink and extends upwardly along the axial direction of the heat sink, the light source board comprises a space-providing hole penetrating through the light source board along a thickness direction of the light source board and configured to correspond to the installation post, an end surface of the installation post comprises a screw hole, and a bolt passes through the space-providing hole to be fixedly connected to the installation post.

In a preferred embodiment, the lamp shade is connected to the upper end surface of the heat sink through a buckle structure.

In a preferred embodiment, the lamp shade is bonded to the upper end surface of the heat sink.

In a preferred embodiment, the paddle member comprises an extending post, and a front end of the extending post comprises a locking groove configured to engage with the paddle handle to define a linkage connection.

In a preferred embodiment, the paddle member comprises two elastic hooks disposed on both sides of the extending post, and movement between the two elastic hooks and the space-providing opening is inhibited in a direction opposite to an inserting direction of the paddle member.

In a preferred embodiment, a front end of each of the two elastic hooks comprises a guiding inclined surface. When the two elastic hooks are inserted into the space-providing opening, the guiding inclined surfaces abut an edge of the space-providing opening to generate a pressing force to enable the two elastic hooks to be deformed toward each other.

Compared with the existing techniques, the technical solution has the following advantages.

The present disclosure provides an LED light bulb, which has a simple structure, is easy to assemble, and saves costs. It also changes the traditional switch assembly method.

DETAILED DESCRIPTION OF THE EMBODIMENTS

Figure 1:
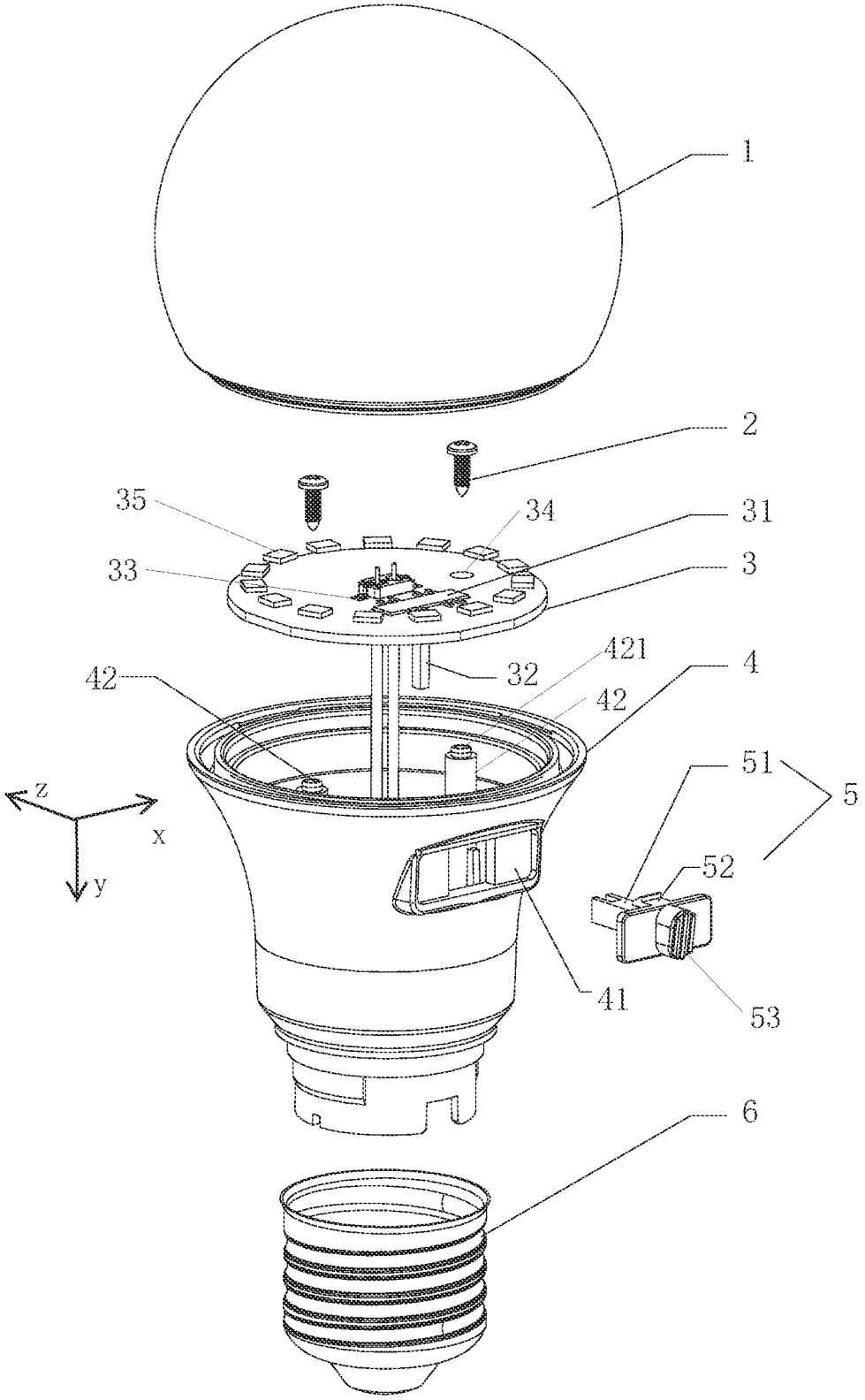
FIG. 1 illustrates an exploded view of an LED light bulb in a preferred embodiment of the present disclosure.

The following will clearly and completely describe the technical solutions in the embodiments of the present disclosure with reference to the accompanying drawings. Obviously, the described embodiments are only a portion of the embodiments of the present disclosure, and not all of the embodiments. Based on the embodiments of the present disclosure, all other embodiments obtained by those of ordinary skill in the art without creative work fall within the protection scope of the present disclosure.

In the description of the present disclosure, it should be noted that the terms "upper", "lower", "inner", "outer", "top/bottom", etc. indicate the orientation or positional relationship based on the orientation shown in the drawings. The positional relationship is only for the convenience of describing the present disclosure and simplifying the description, rather than indicating or implying that the pointed device or element must have a specific orientation, be constructed, and be operated in a specific orientation. Therefore, the positional relationship should not be understood as a limitation of the present disclosure. In addition, the terms "first" and "second" are only used for descriptive purposes and should not be understood as indicating or implying relative importance.

In the description of the present disclosure, it should be noted that the terms "installed", "provided with", "sleeved/connected", "connected", etc., should be understood broadly. For example, "connected" can be a fixed connection, a detachable connection, or an integral connection, a mechanical connection, an electrical connection, a direct connection, or an indirect connection through an intermediate medium, and it can be a connection between two members. For those of ordinary skill in the art, the specific meaning of the above terms in the present disclosure can be understood under specific conditions.

Figure 2:
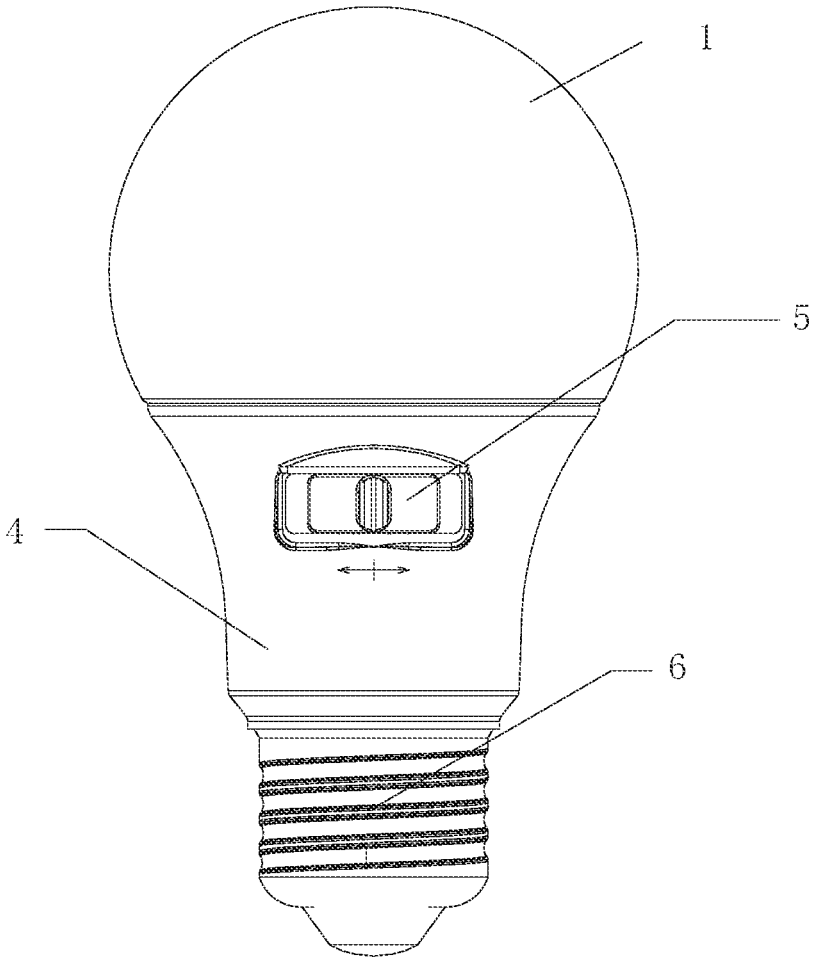
FIG. 2 illustrates a front view of the LED light bulb in the preferred embodiment of the present disclosure.
Figure 3:
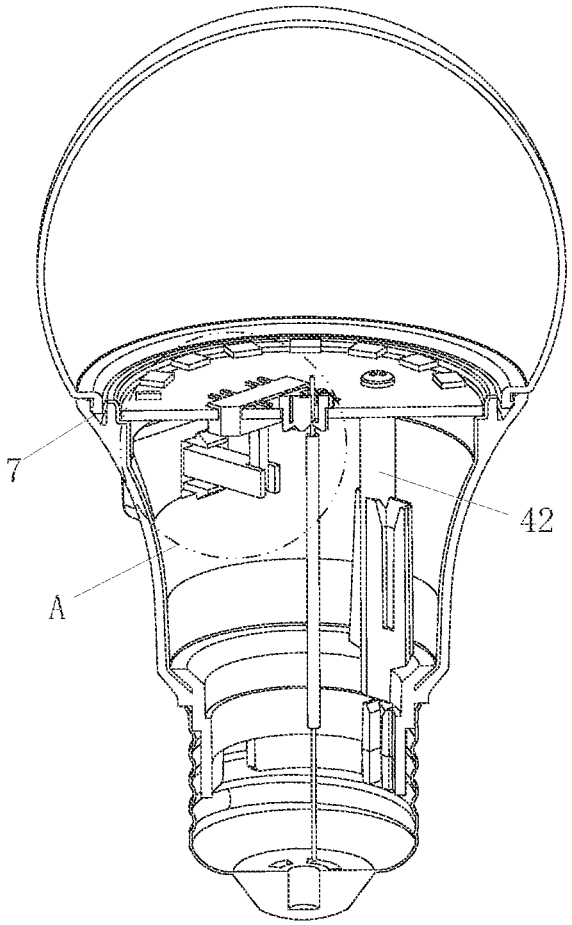
FIG. 3 illustrates a cross-sectional view of the LED light bulb in the preferred embodiment of the present disclosure.
Figure 4:
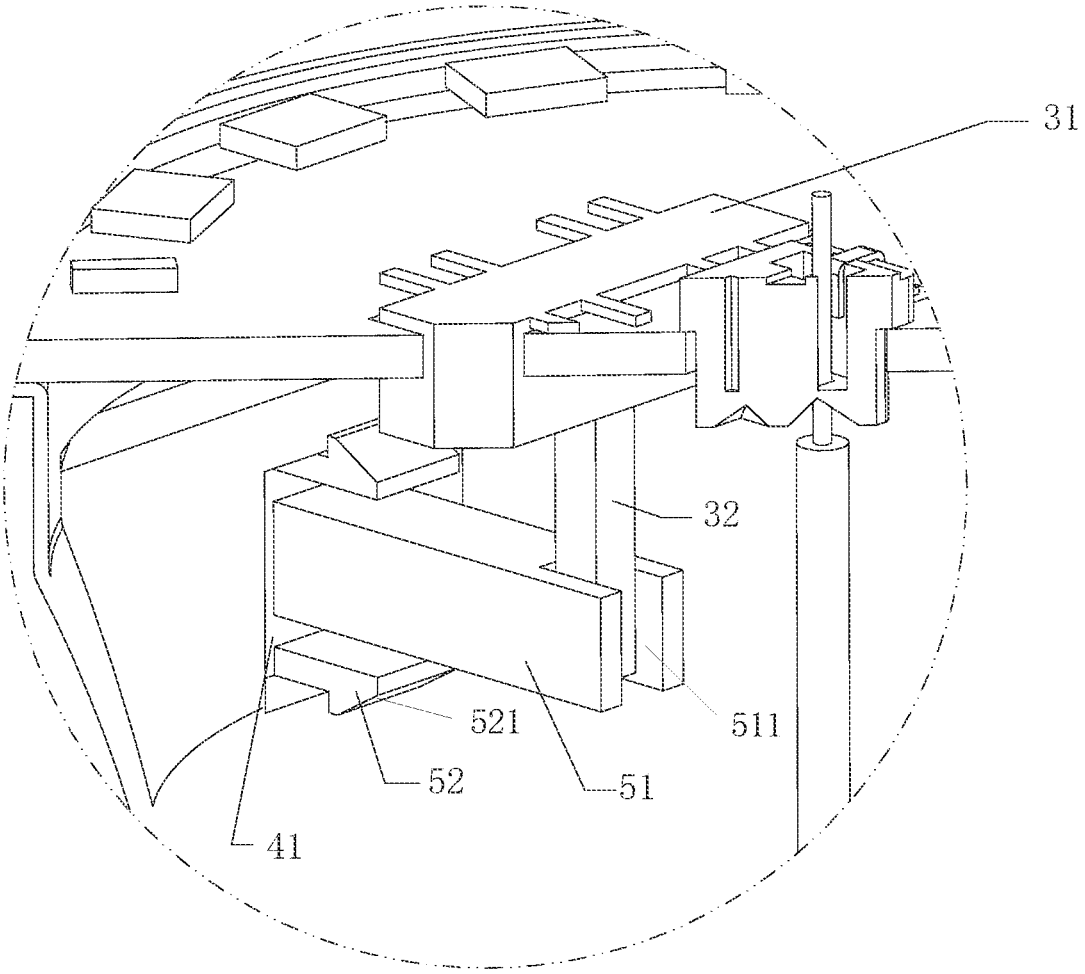
FIG. 4 illustrates an enlarged perspective view of an encircled portion A in FIG. 3.

Referring to FIGS. 1-4, a light emitting diode (LED) light bulb of an embodiment is provided. The LED light bulb comprises a light source board 3, a heat sink 4, a lamp shade 1, and a paddle member 5.

The light source board 3 is disposed on an upper end surface of the heat sink 4 in an axial direction (e.g., measured along the y-axis in FIG. 1) of the heat sink 4. The lamp shade 1 is connected to the upper end surface of the heat sink 4 to enable the light source board 3 to be contained within the lamp shade 1.

The light source board 3 comprises a patch switch 31, and a paddle handle 32 of the patch switch 31 extends downwardly along the axial direction of the heat sink 4. The heat sink 4 comprises a space-providing opening 41, and a front end of the paddle member 5 is configured to extend through the space-providing opening 41 and to be operatively coupled to the paddle handle 32. A rear end of the paddle member 5 is configured to be exposed out of an outer wall of the heat sink 4 to define an operating member 53, and the operating member 53 is configured to be toggled to adjust turning ON and OFF of LED beads 35 of different colors disposed on the light source board 3.

Specifically, the paddle member 5 comprises an extending post 51, and a front end of the extending post 51 comprises a locking groove 511 configured to engage with the paddle handle 32 to define a linkage connection.

In order to realize the installation of the paddle member 5 and the space-providing opening 41, the paddle member 5 comprises two elastic hooks 52 disposed on both sides of the extending post 51, and movement between the two elastic hooks 52 and the space-providing opening 41 is inhibited in a direction opposite to an inserting direction (e.g., measured along the z-axis in FIG. 1) of the paddle member 5. Specifically, a front end of each of the two elastic hooks 52 comprises a guiding inclined surface 521. When the two elastic hooks 52 are inserted into the space-providing opening 41, the guiding inclined surfaces 521 abut an edge of the space-providing opening 41 to generate a pressing force to enable the two elastic hooks 52 to be deformed toward each other.

In this embodiment, the light source board 3 comprises a driver circuit 33. A lower end of the heat sink 4 in the axial direction of the heat sink 4 is connected to a light bulb base 6. A positive input terminal and a negative terminal of the driver circuit 33 are respectively electrically connected to a positive contact and a negative contact of the light bulb base 6.

In addition, the LED beads 35 disposed on the light source board 3 are arranged in a circumferential array to define a circle, and the patch switch 31 is disposed in the circle defined by the LED beads 35.

In order to install the light source board 3, an installation post 42 is defined within the heat sink 4 and extends upwardly along the axial direction of the heat sink 4, and light source board 3 comprises a space-providing hole 34 penetrating through the light source board 3 along a thickness direction (e.g., measured along the y-axis in FIG. 1) of the light source board 3 and configured to correspond to the installation post 42. An end surface of the installation post 42 comprises a screw hole 421, and a bolt 2 passes through the space-providing hole 34 to be fixedly connected to the installation post 42.

In this embodiment, the lamp shade 1 is connected to the upper end surface of the heat sink 4 through a buckle structure 7. As a simple replacement of this embodiment, the lamp shade 1 is bonded to the upper end surface of the heat sink 4.

The aforementioned embodiments are merely some embodiments of the present disclosure, and the scope of the disclosure is not limited thereto. Thus, it is intended that the present disclosure cover any modifications and variations of the presently presented embodiments provided they are made without departing from the appended claims and the specification of the present disclosure.

What is claimed is:

1. A light emitting diode (LED) light bulb, comprising:
a light source board,
a heat sink,
a lamp shade, and
a paddle member, wherein:
the light source board is disposed on an upper end surface of the heat sink in an axial direction of the heat sink,
the lamp shade is connected to the upper end surface of the heat sink to enable the light source board to be contained within the lamp shade,
the light source board comprises a patch switch,
the patch switch comprises a paddle handle extending downwardly along the axial direction of the heat sink,
the heat sink comprises a space-providing opening,
a front end of the paddle member is configured to extend through the space-providing opening and to be operatively coupled to the paddle handle,
a rear end of the paddle member is configured to be exposed out of an outer wall of the heat sink to define an operating member, and
the operating member is configured to be toggled to adjust turning ON and OFF of LED beads of different colors disposed on the light source board.

2. The LED light bulb according to claim 1, wherein:
the light source board comprises a driver circuit.

3. The LED light bulb according to claim 2, wherein:
a lower end of the heat sink in the axial direction of the heat sink is connected to a light bulb base, and
a positive input terminal and a negative terminal of the driver circuit are respectively electrically connected to a positive contact and a negative contact of the light bulb base.

4. The LED light bulb according to claim 1, wherein:
the LED beads disposed on the light source board are arranged in a circumferential array to define a circle, and
the patch switch is disposed in the circle defined by the LED beads.

5. The LED light bulb according to claim 1, wherein:
an installation post is defined within the heat sink and extends upwardly along the axial direction of the heat sink,
the light source board comprises a space-providing hole penetrating through the light source board along a thickness direction of the light source board and configured to correspond to the installation post, an end surface of the installation post comprises a screw hole, and a bolt passes through the space-providing hole to be fixedly connected to the installation post.

6. The LED light bulb according to claim 1, wherein:

the lamp shade is connected to the upper end surface of the heat sink through a buckle structure.

7. The LED light bulb according to claim 1, wherein:

the lamp shade is bonded to the upper end surface of the heat sink.

8. The LED light bulb according to claim 1, wherein:

the paddle member comprises an extending post, and a front end of the extending post comprises a locking groove configured to engage with the paddle handle to define a linkage connection.

9. The LED light bulb according to claim 8, wherein:

the paddle member comprises two elastic hooks disposed on both sides of the extending post, and movement between the two elastic hooks and the space-providing opening is inhibited in a direction opposite to an inserting direction of the paddle member.

10. The LED light bulb according to claim 9, wherein:

a front end of each of the two elastic hooks comprises a guiding inclined surface, and when the two elastic hooks are inserted into the space-providing opening, the guiding inclined surfaces abut an edge of the space-providing opening to generate a pressing force to enable the two elastic hooks to be deformed toward each other.

* * * * *